United States Patent [19]

Valavaara

[11] Patent Number: 4,734,013

[45] Date of Patent: Mar. 29, 1988

[54] ROTARY PRESSURE INTENSIFIER

[75] Inventor: Viljo K. Valavaara, Don Mills, Canada

[73] Assignee: V-Tech Industries Inc., Mississauga, Canada

[21] Appl. No.: 24,790

[22] Filed: Mar. 11, 1987

Related U.S. Application Data

[63] Continuation-in-part of Ser. No. 829,919, Feb. 18, 1986, abandoned.

[51] Int. Cl.[4] ..... F04B 17/00; F04B 1/18; F01B 3/00

[52] U.S. Cl. ..... 417/225; 417/271; 417/387; 417/473; 91/502; 91/503

[58] Field of Search ..... 417/271, 269, 386, 387, 417/473, 225; 60/593; 91/502, 503

[56] References Cited

U.S. PATENT DOCUMENTS

| | | | |
|---|---|---|---|
| 1,019,521 | 3/1912 | Pratt | 417/271 |
| 2,243,978 | 6/1941 | Reader | 417/271 X |
| 2,356,917 | 8/1944 | Chouinas | 417/271 |
| 2,762,307 | 9/1956 | Orloff | 417/271 |
| 2,807,215 | 9/1957 | Hawxhurst | 417/388 |
| 2,845,030 | 7/1958 | Febvre et al. | 417/271 |
| 2,876,704 | 3/1959 | Collion et al. | 417/271 |
| 2,935,952 | 5/1960 | Rose | 417/271 X |
| 3,133,503 | 5/1964 | Sheler | 417/271 X |
| 3,314,367 | 4/1967 | Livers | 417/271 |
| 3,323,461 | 6/1967 | Bennett | 417/387 X |
| 3,811,798 | 5/1974 | Bickford | 417/269 |
| 4,286,927 | 9/1981 | Boehringer | 417/271 |
| 4,342,544 | 8/1982 | Pere | 417/269 |
| 4,363,211 | 12/1982 | Robinson et al. | 417/271 X |
| 4,465,438 | 8/1984 | Brauer et al. | 417/386 |
| 4,583,921 | 4/1986 | Wolff et al. | 417/269 |

FOREIGN PATENT DOCUMENTS

| | | | |
|---|---|---|---|
| 3027878 | 2/1982 | Fed. Rep. of Germany | 60/593 |
| 28076 | 2/1984 | Japan | 417/271 |

*Primary Examiner*—Carlton R. Croyle
*Assistant Examiner*—Paul F. Neils
*Attorney, Agent, or Firm*—George A. Rolston

[57] ABSTRACT

A pressure intensifier for a fluid comprises at least three piston assemblies disposed along mutually parallel axes equiangularly disposed with respect to a central axis of the intensifier and radially equidistant therefrom. Each piston assembly has two opposed high pressure cylinders and low pressure cylinders. Fluid is supplied to the low pressure cylinders and discharged through a low pressure valve operatively coupled by a swash plate to the pistons of each assembly so as to be driven thereby. A high pressure collector, optionally in the form of a closed circuit, is provided for receiving high pressure fluid from the high pressure cylinders.

13 Claims, 11 Drawing Figures

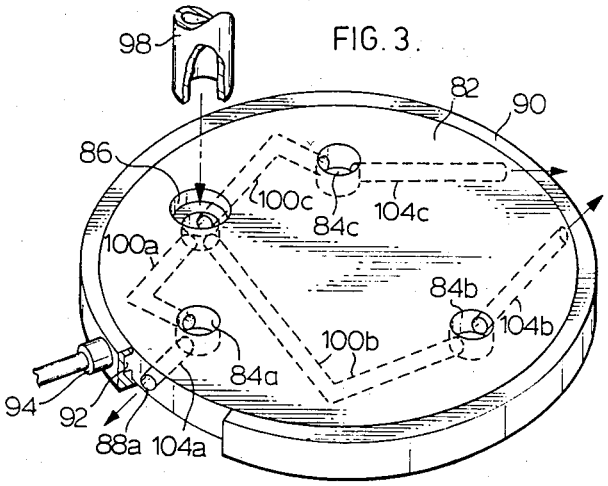
FIG. 3.
FIG. 4.
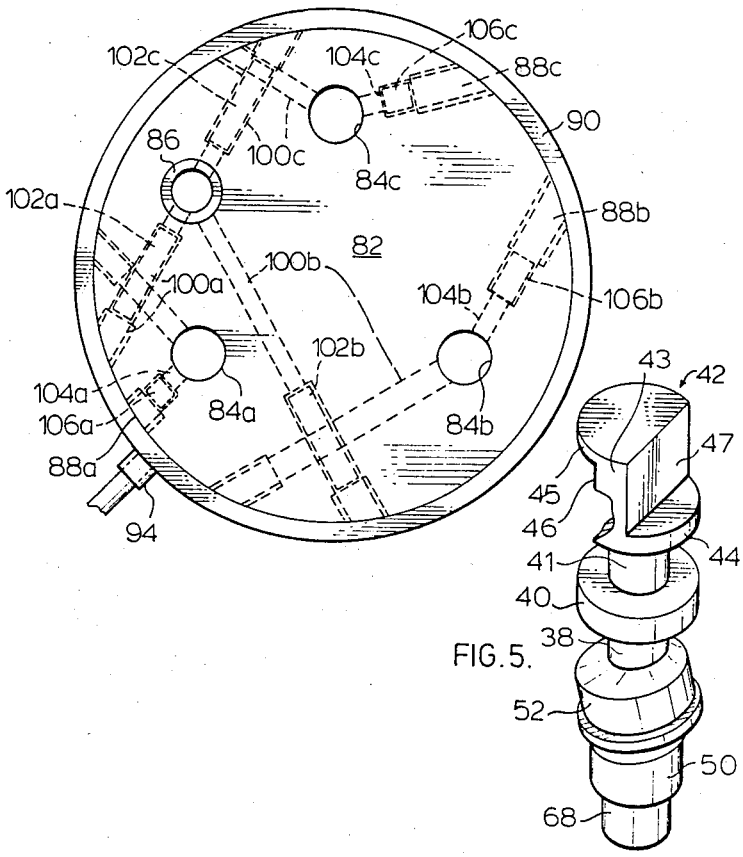
FIG. 5.

ROTARY PRESSURE INTENSIFIER

This application is a continuation-in-part of U.S. patent application Ser. No. 829,919 now abandoned in the name of Viljo K. Valavaara assigned to 685562 Ontario Ltd., as filed Feb. 18, 1986 and entitled "ROTARY PRESSURE INTENSIFIER".

FIELD OF THE INVENTION

The invention relates to a pressure intensifier for use in association with a pressurized fluid and for converting and intensifying the pressure of such a fluid.

BACKGROUND OF THE INVENTION

Devices are available for increasing fluid and liquid pressures, which are dependent on some outside power source or motor, i.e., pumps, compressors, etc.

Other forms of devices are directed to the intensification of the pressure of a fluid medium by utilizing the pressure of the medium as the power source. In other words, in theory this can be achieved simply by exchanging or transforming a given volume of medium at a first pressure with a reduced volume of medium at an increased pressure. A portion of the volume of the medium will thus become waste. A smaller volume at the increased pressure will then be obtained and utilized for whatever purpose it is required. Such systems offer attractive possibilities.

In many instances it is desirable to utilize a high pressure jet for example of water for cleaning, cutting, pulverizing or the like. However, in the great majority of cases, the approach to producing such high pressure jet is to apply some form of exterior power such as an electrical or other motor, and a pump.

These systems are therefore relatively expensive. In addition in, for example, a high pressure water jet powered by an electrical pump, rigid precautions are needed to ensure safety from electric shock. Complex continuous flow circulation systems are required to eliminate "hammer" and turbulence.

For many reasons, therefore, it is desirable where possible for a fluid pressure intensifier to operate solely from the pressure of the fluid medium. In the past, such self-powered pressure intensifiers as have been available were generally based on some form of double acting piston design. However, such earlier designs have generally speaking been relatively costly and cumbersome, involving numerous parts, and have also incorporated various inefficiencies, leading to considerable wastage in pressure and volume. One of the problems of earlier designs is the intermittent nature of the high pressure flow. Piston type intensifiers usually produce an intermittent flow in which the high pressure exists as a series of high pressure pulses. Clearly, it is desirable to use multiple pistons and to operate them at a sufficient speed to smooth out these pulses as far as possible.

One of the sources of inefficiency in prior art design is the power loss involved in returning each piston after its power stroke. It is desirable as far as possible to reduce this power loss and also to render the return stroke of the piston as far as possible free of interference or resistance.

In the case of compressors for fluids such as gases and air it is usual to employ a compressor having reciprocating pistons and connecting rods, and a crank shaft similar to the design of gasoline engines. Such a compressor is driven, via the crank shaft, by any suitable motor, e.g., a gasoline or diesel engine, in many cases.

Compressors of this design are known to be relatively inefficient and the manufacturing cost is relatively high. Maintenance costs can also be significant. The use of connecting rods and bearings involves large masses of metal reciprocating to and fro with consequent losses. In addition, reciprocating pistons of this type produce pressure only on one half of the stroke, the other half being merely a dead movement for return. Consequently, the fluid medium is subjected to pressure pulses. To overcome this, a pressure storage tank or accumulator is usually provided to accumulate fluid under pressure. This still further increases the expense.

Clearly, it is desirable to provide a compressor without these disadvantages, and in which mechanical movement is reduced.

In general the approach of the invention is to provide a pressure intensifier which utilizes the pressure of a fluid medium, i.e., air, water or a hydraulic fluid, to either increase the pressure of the fluid medium (e.g., the air, oil or water), or uses the pressure of one fluid medium to intensify the pressure of another fluid medium.

In either case the general principles of the pressure intensifier mechanism are generally similar, and the appearance is similar.

SUMMARY OF THE INVENTION

The invention seeks to overcome the foregoing disadvantages by the use of a pressure intensifier for a fluid medium having at least three piston assemblies disposed along mutually parallel axes equiangularly disposed with respect to a central axis of the intensifier and radially equidistant therefrom. Fluid is supplied to the low pressure cylinders from a supply means and discharged to a discharge means through a low pressure valve means operatively coupled to the pistons of the piston assemblies so as to be driven by axial movement of such pistons.

The invention relates to an intensifier for a fluid medium and comprising:

a stationary low pressure cylinder block portion;

stationary high pressure cylinder block portions;

at least three piston assemblies, said piston assemblies being disposed along mutually parallel axes equiangularly disposed with respect to a central axis of said intensifier and radially equidistant therefrom, each said piston assembly comprising:

low pressure cylinder means in said low pressure cylinder block portion;

a pair of axially aligned and opposed high pressure cylinders coaxially disposed with said low pressure cylinder means in said high pressure cylinder block portions;

low pressure piston means disposed within said low pressure cylinder means for axial movement therein; and, a pair of high pressure pistons disposed within respective ones of said high pressure cylinders for axial movement therein, each said high pressure piston being connected to said low pressure piston means for conjoint axial movement therewith;

low pressure fluid supply means for the supply of low pressure fluid to said low pressure cylinder means of each said piston assembly;

low pressure fluid discharge means for the discharge of low pressure fluid from said low pressure cylinder means of each said piston assembly;

movable low pressure valve means in said low pressure cylinder block portion and disposed along a central axis thereof within said mutually parallel axes of said piston assemblies, and being movable within said low pressure block portion, said valve means being coupled to said low pressure cylinder means of each said piston assembly and adapted to control the supply of low pressure fluid to said low pressure cylinder means of each said piston assembly from said low pressure fluid supply means and to control the discharge of low pressure fluid from said low pressure cylinder means of each said piston assembly to said low pressure fluid discharge means;

valve drive transmission means operatively coupled to each of said piston assemblies between said two high pressure pistons of each said piston assembly, and disposed within said mutually parallel axes of said piston assemblies whereby movement of said piston assemblies in response to supply of low pressure fluid will cause movement of said low pressure valve means, and simultaneously synchronize movement of said piston assemblies;

high pressure fluid supply means for supplying fluid to said high pressure cylinders; and, high pressure fluid collector means for receiving high pressure fluid from said high pressure cylinders.

In one form of such an intensifier, the low pressure valve means is driven by a valve drive transmission means operatively interconnecting the pistons of the piston assemblies to such low pressure valve means. In one arrangement, the valve means comprise a central rotary valve shaft with a rotary valve mounted on that shaft. The valve drive transmission means may comprise a swash plate which engages the pistons of each assembly.

In accordance with one feature of this invention utilizing such a swash plate, the valve means is in the form of a ball connected to or forming part of the swash plate so as to be movable therewith and which is movably supported in a fixed cup formed in the intensifier. A supply passage and a plurality of transfer passages communicating with respective ones of the low pressure cylinders, which passages open as ports in such a cup, are then provided for cooperation with recesses formed in the surface of the ball for permitting fluid transfer between respective pairs of said ports during operation of the intensifier.

In accordance with another feature of this invention, each piston assembly of such an intensifier comprises a pair of axially aligned and opposed high pressure cylinders coaxially disposed with the low pressure cylinder and a pair of high pressure pistons disposed within respective ones of the high pressure cylinders for axial movement therein, each high pressure piston being connected to the low pressure piston for conjoint axial movement therewith.

In such an intensifier in accordance with this invention each piston assembly preferably also comprises two low pressure cylinders with two low pressure pistons therein and such low pressure pistons of each piston assembly are connected to respective ones of the high pressure pistons of that piston assembly to provide first and second pairs of high pressure cylinders and pistons and low pressure cylinders and pistons. Linkage means are then provided between the first and second pairs of high and low pressure pistons in each assembly for transmitting axial movement therebetween.

In accordance with a particularly useful feature of such an intensifier in accordance with the invention, the high pressure cylinders and the low pressure cylinders of each piston assembly are interconnected and the low pressure pistons are connected to the low pressure valve means by the valve drive transmission means so that, in each piston assembly, axial movement of the low pressure piston of one of the first and second pairs of cylinders and pistons is effective through a respective one of the linkage means to cause axial movement of the high pressure piston of the other of the first and second pairs of cylinders and pistons.

In accordance with yet another feature of this invention, the high pressure cylinders and the high pressure fluid collector means of an intensifier of the type described form a closed circuit including pressure reaction means for reaction to high pressure therein.

In accordance with another useful feature of this invention, an intensifier of the type described is constructed with a multi-partite body so that the low pressure cylinders are located in a low pressure cylinder block portion and the high pressure cylinders are located in a high pressure cylinder block portion, the intensifier also including spacer means extending between such low pressure and high pressure cylinder block portions. Such multi-partite construction has proven to be particularly beneficial in facilitating maintenance and repair of such an intensifier.

In accordance with another feature of the present invention, an intensifier of the type described is provided with a novel design and construction for the high pressure collector means as well as with a novel construction in which the high pressure cylinders and the high pressuure fluid collector means comprises a closed circuit.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

FIG. 3 is an enlarged perspective of a detail of FIGS. 1 and 2 showing conduits in phantom, and partly cut away;

FIG. 4 is an enlarged plan view of FIG. 3, showing valves and conduits in phantom;

FIG. 5 is a perspective of the rotary valve and swash plate assembly;

DESCRIPTION OF THE PREFERRED EMBODIMENTS

Figure 1:
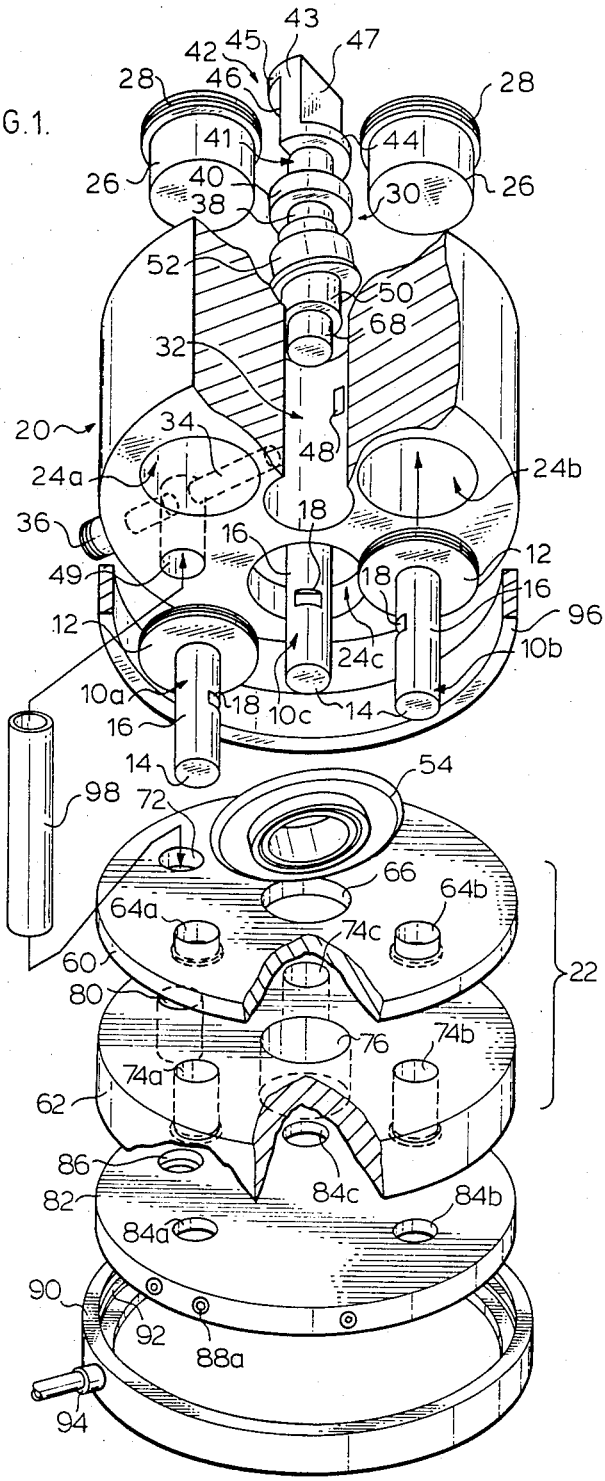
FIG. 1 is an exploded perspective illustration of a pressure intensifier according to the invention.

Before describing the construction of the pressure intensifier according to the invention, it will be understood that what is described is suitable for use in a variety of different situations. For example, on a small scale, it may be used in domestic applications such as a bathroom accessory or a kitchen accessory, or on a slightly larger scale as an outdoor attachment to a garden hose for example. In other circumstances, it may be used commercially, for example, to provide hydraulic power from a compressed air source, or to provide a high pressure cutting jet.

It will, therefore, be appreciated that the invention is illustrated as a pressure intensifier per se. In use, it could be incorporated in some other article such as a hand-held water jet sprayer, dishwasher, bathroom appliance, or the like, as an integral component thereof.

For the present purposes, however, for the description of this invention, no such appliance or other device is illustrated.

On the other hand, the device might be incorporated in a simple system of liquid supply and outlet conduits, where the higher pressure liquid will be used somewhere downstream, in some other unrelated equipment.

With reference now to the drawings, it will be seen that the pressure intensifier shown in FIGS. 1 to 5 comprises a plurality, in this case, three, combined low and high pressure piston assemblies each of which is illustrated as 10*a*, 10*b*, and 10*c*. In this description, when a number of identical components are indicated by a numerical legend followed by alphabetical suffices, such components will collectively be indicated by the same legend without such suffices. For example, the piston assemblies 10*a*, 10*b* and 10*c* will be collectively referred to as assemblies 10.

Each low and high pressure piston assembly comprises a relatively large diameter low pressure piston 12 and a relatively small diameter high pressure piston 14. The two pistons 12 and 14 are connected together by a piston rod extension 16.

In the embodiment as illustrated, the high pressure piston 14 and the extension 16 are integral structures formed with the same diameter and of the same piece of material. It will, however, be appreciated that this is not necessary for the purposes of the invention.

In each of the piston rod extensions 16, there is provided a bearing notch 18, for purposes to be described below.

In order to receive the pistons 10, there are provided a low pressure cylinder body 20, and a high pressure cylinder body 22. The low pressure cylinder body 20 comprises a plurality of, in this case, three, low pressure cylinders 24*a*, 24*b* and 24*c*, formed around the perimeter of a circle, the centre of the circle being located along the mutual central axis of the bodies 20 and 22.

The lower ends of the low pressure cylinders 24 (as shown in the drawings) are open, and the upper ends of the cylinders 24 are closed by plug members 26. This arrangement is merely for the sake of simplicity and economy in machining and fabricating. The plug members 26 are of reduced diameter, to define an annular liquid flow space therearound, and are closed off at their upper ends by means of closure discs 28.

In order to supply low pressure fluid to the upper ends of cylinders 24, and thereby operate the low pressure pistons 12, there is provided a rotary valve assembly indicated generally as 30. The rotary valve assembly 30 is located within a central axial bore 32 formed in body 20. A low pressure fluid supply conduit 34 is formed through body 20, and communicates with bore 32. Fluid may be supplied by means, for example, of a supply hose or the like to a supply hose fitting indicated generally as 36.

The valve assembly 30 will be seen to comprise a central stem or shaft 38 of reduced diameter relative to bore 32. A sealing collar 40 closes off the lower region of bore 32 from access to low pressure fluid. An annular valve neck 41 is formed integrally with shaft 38 spaced above collar 40. An upper valve segment generally indicated at 42 is provided at the upper end of neck 41. Upper valve segment 42 is divided by axially extending valve partition wall 43.

A lower semi-circular transverse wall 44 partially separates lower valve neck 41 from upper valve segment 42. An upper semi-circular transverse wall 45 partially closes off the upper end of upper valve segment 42. Walls 44 and 45 are on opposite sides of segment 42.

Valve segment 42 is further provided with a fluid distribution face 46 and a fluid ejection face 47, which are on opposite sides of the axial partition wall 43.

As the valve assembly 30 rotates, fluid is first of all received in the lower valve neck 41, then transferred to the distribution face 46, and thus to the respective low pressure cylinder 24 forcing the corresponding low pressure piston 12 to move axially downwardly, as viewed in the drawing. When the low pressure pistons 12 move in the opposite direction, i.e., upwardly on the return stroke, fluid from the low pressure cylinders 24 is then ejected back to the valve assembly 30.

Figure 2:
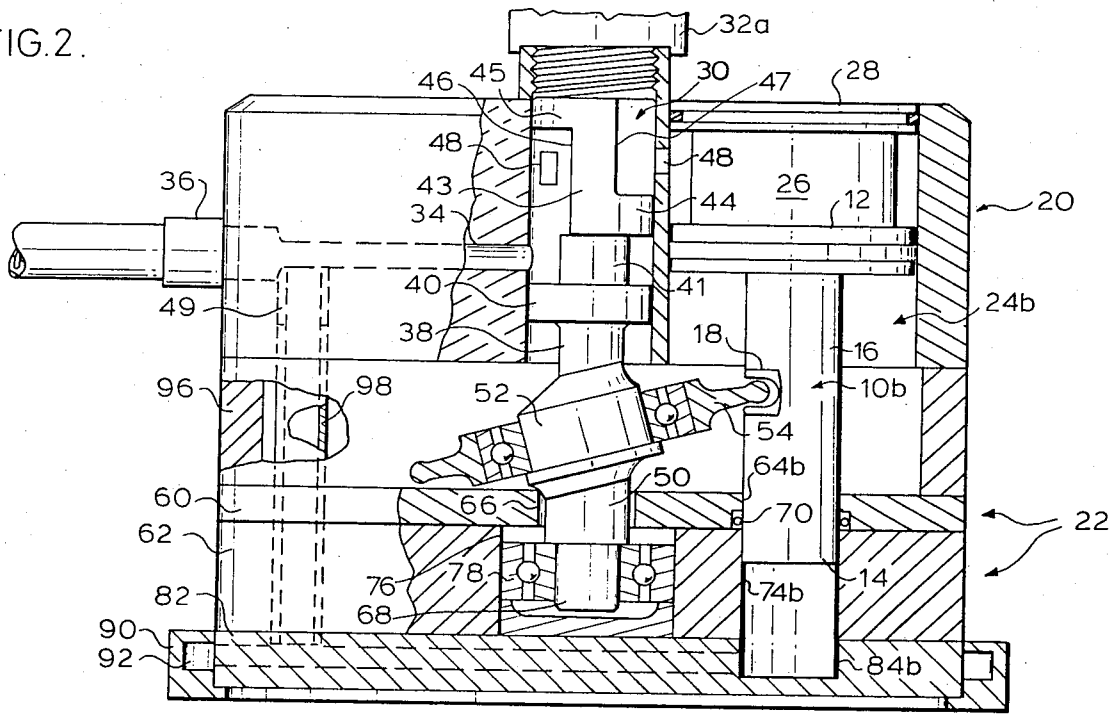
FIG. 2 is a sectional side elevation through the pressure intensifier of FIG. 1 when assembled.

The upper end of bore 32 is open, so that fluid from valve face 47 can be ejected through, for example, low pressure fluid outlet fitting 32*a* (FIG. 2).

Bore 32 is provided with a plurality, in this case three, liquid supply and return ports 48, each port 48 communicating from upper valve segment 42, with a respective cylinder 24 adjacent the annular space surrounding plug 26.

A low pressure fluid transfer conduit 49 extends downwardly from the fluid supply conduit 34 for a reason to be described.

Shaft 38 is connected to a transmission device, in this case a swash plate shaft50, extending downwardly through the lower ends of bore 32. Shaft 50 has an angled bushing portion 52, carrying a rotary annular swash plate 54 (omitted from FIG. 5). Swash plate 54 rides in the notches 18, formed in the piston rod extensions 16.

The high pressure cylinder body 22 is formed of two separate body portions 60 and 62. This two-part construction facilitates its manufacture and repair in the event of failure. It will also be understood that the high pressure section of the intensifier is subject to considerable stresses during operation and is, therefore, more susceptible to fatigue failure. It is, however, also possible to manufacture the body 22 as a single body.

Body portion 60 is a disc-like member of relatively thin cross-section, and is formed with three high pressure cylinders 64, two of which 64*b* and 64*c* are shown in the drawings. These cylinders 64 are axially aligned with respective ones of the low pressure cylinders 24, so that the piston assemblies 10 can be received in the respective pairs of cylinders 24 and 64.

A central or axial opening 66 is provided to receive the shaft 50. Cylinders 64 are counterbored to provide recesses for seals 70 which are continuously engaged by the high pressure pistons 14 during operation of the intensifier.

A low pressure conduit passage 72 extends through body portion 60 for transfer of low pressure fluids in a manner to be described below.

High pressure cylinder body portion 62 is formed with high pressure cylinders 74*a*, 74*b* and 74*c*, aligned with cylinders 64 and cylinders 24. Body 62 also has an axial bearing opening 76 aligned with opening 66. Opening 76 receives bearing 78 on the lower end 68 of shaft 50.

A low pressure conduit passage 80 is formed through body 62, aligned with passage 72.

In order to distribute low pressure fluid, and to collect high pressure fluid, a collector and transfer plate 82 is provided beneath body 62. Plate 82 is provided with three high pressure fluid wells 84*a*, 84*b*, and 84*c*, which are axially aligned with respective ones of the high pressure cylinders 74.

A low pressure distribution well 86 is formed aligned with low pressure conduit passage 80. Wells 84 and 86 are interconnected with one another by a series of drillings or conduits in the radial plane as described below with reference to FIGS. 3 and 4.

The wells 84*a*, 84*b* and 84*c* are also connected by further drillings to respective high pressure outlet openings 88*a*, 88*b* and 88*c*. Suitable one-way check valves to be described below are incorporated in the plate 82 to control flow.

A high pressure fluid collector ring 90 fits around plate 82. Ring 90 is provided with an interior annular groove 92 and a single high pressure outlet 94.

The body 20, body portions 60 and 62, transfer plate 82 and collector ring 90 are held together by suitable bolts or clamps (not shown), the details of which are omitted for the sake of clarity.

A spacer ring 96 is fitted between body 20 and body portion 60, and encloses the space around swash plate 54. In order to communicate low pressure fluid from body 20 to transfer plate 82, a low pressure pipe 98 is provided, which is connected by any suitable means (not shown) to low pressure transfer conduit 49 in body 20. Low pressure pipe 98 passes through the space enclosed by spacer ring 96, and through passages 72 and 80, into well 86 in plate 82.

As best shown in FIGS. 3 and 4, plate 82 is provided with low pressure drillings or conduits 100*a*, 100*b*, 100*c*, each of which is provided with a respective one-way check valve 102*a*, 102*b*, 102*c* (not shown in FIG. 3).

The wells 84*a*, 84*b*, 84*c* are also provided with high presure conduits 104*a*, 104*b*, 104*c*, each of which contains a respective one-way check valve 106*a*, 106*b*, 106*c* (not shown in FIG. 3).

Conduits 104 terminate at outlets 88, and deliver high pressure fluid to groove 92 and outlet 94.

In operation, low pressure fluid is supplied through supply fitting 36 and conduit 34 to the valve neck 41 in bore 32. Simultaneously, low pressure fluid is also supplied via transfer conduit 49 and pipe 98 to distribution well 86 in plate 82. This low pressure fluid will flow from distribution well 86 through conduits 100 and one-way check valves 102 to the three high pressure cylinder wells 84.

Low pressure fluid from neck 41 will flow up to the distribution face 46 of valve segment 42. It will then flow into whichever one of ports 48 is registering with face 46. Fluid will then apply pressure to the upper surface of the respective piston 12, causing it to move downwardly, i.e., toward the high pressure cylinders 64 and 74.

As one of the high pressure pistons 14 moves downwardly within a respective one of the high pressure cylinders 64–74, the fluid in that high pressure cylinder will thereby be subjected to a pressure which is a multiple of the low pressure applied to the low pressure piston 12 by the low pressure fluid. The fluid in the high pressure cylinder will thus be subjected to a much higher pressure than that in the low pressure cylinder. The seals 70 are effective to minimize loss of high pressure fluid through the space between the high pressure pistons 14 and the cylinder bores 64.

As such high pressure piston 14 continues to move downwardly, it will force the high pressure fluid out of the respective high pressure outlet conduit 104 and through the respective one-way check valve 106 into the collector groove 92 in the collector ring 90.

As such high piston 12 is forced downwardly by the low pressure fluid, it will be course cause rotation of swash plate 54, thereby rotating the shaft 38, and bringing the distribution face 46 into registration with a new one of ports 48.

Rotation of swash plate 54 will also cause one of the other piston assemblies 10 to move upwardly, thereby ejecting the low pressure fluid from that low pressure cylinder 24. The low pressure fluid in that cylinder will then be ejected through the respective port 48 into registration with the ejection face 47. Finally, such fluid will pass out through outlet fitting 32*a*.

Thus so long as low pressure fluid is continuously supplied to the supply fitting 36, the piston assemblies 10 will continue to reciprocate down and up, converting a flow of low pressure fluid of a predetermined volume into a flow of high pressure fluid of a much smaller volume.

The rejected low pressure fluid which is not transferred downwardly to the high pressure cylinders, is merely allowed to run to waste.

Clearly, many variations may be made in the arrangement of the invention. While three pistons and cylinders are shown, it is obvious that there may be more pistons and cylinders, if desired. The rotary valve mechanism as shown is simply one example of a suitable valve mechanism which may be used to distribute the low pressure fluid to and from the cylinders. Many other forms of valve mechanisms may be suitable in other circumstances.

It will also be apparent that in the system already described, the same fluid is used both on the low pressure side and on the high pressure side. This may be suitable in many circumstances such as, for example, in the generation of a high pressure water jet from a lower pressure water source. This may be suitable for use in, for example, the bathroom or in the garden, or in many industrial or commercial applications where a simple high pressure water jet is required. It may also be suitable in high pressure cutting jet applications.

However, there are certain circumstances where it is desirable to use two separate fluids. In this case, an entirely separate source of fluid could be used for supplying the high pressure cylinders through the well 86 and supply conduits 100. In this case, the low pressure supply conduit 98 would not be provided.

Also, in this case, all of the low pressure fluid would be rejected through the outlet fitting 32*a*. This would have certain advantages where it was desired to keep the two fluids, namely the low pressure and high pressure fluids, separate.

It would also enable the use of compressed air as the low pressure source, and water or some other fluid as the high pressure fluid.

In still other circumstances, it may be desirable to provide for a completely sealed high pressure fluid system wherein there is no contact between the high pressure fluid and some other system to which the high pressure is to be applied.

Figure 6:
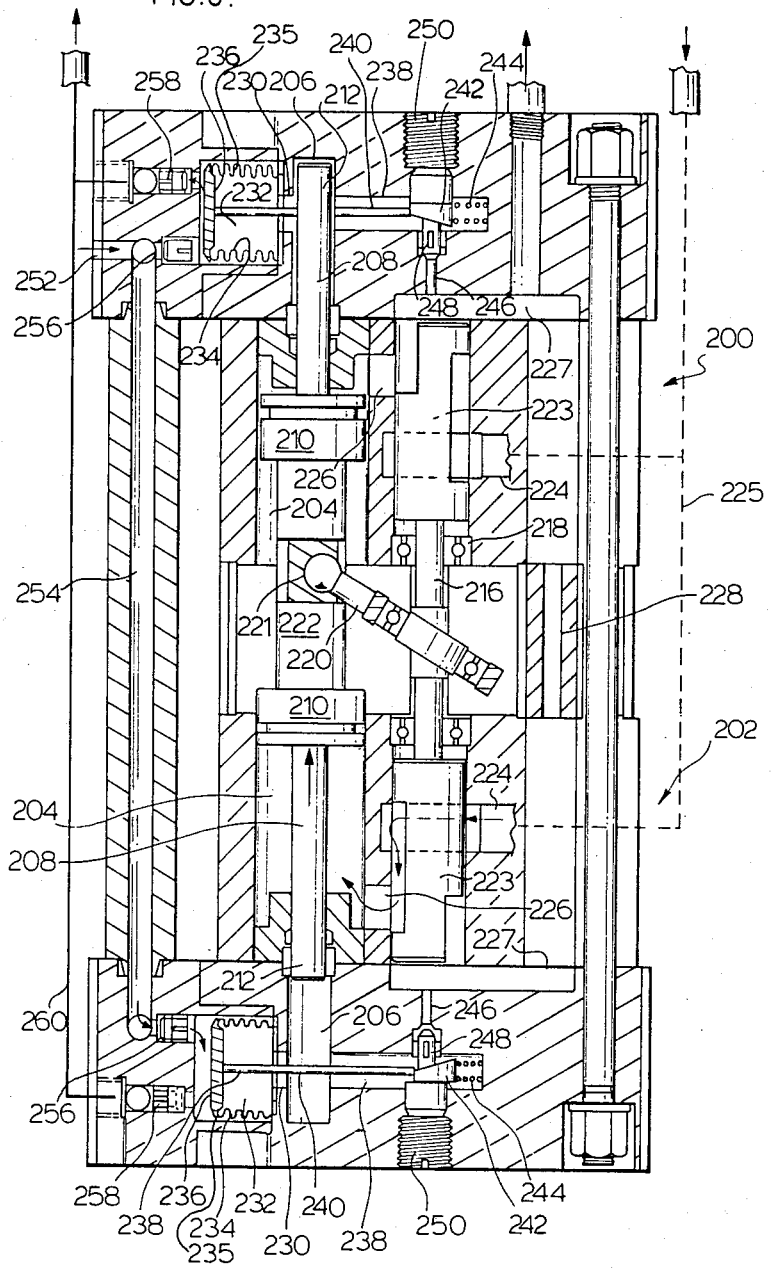
FIG. 6 is a sectional elevation of a further embodiment.
Figure 7:
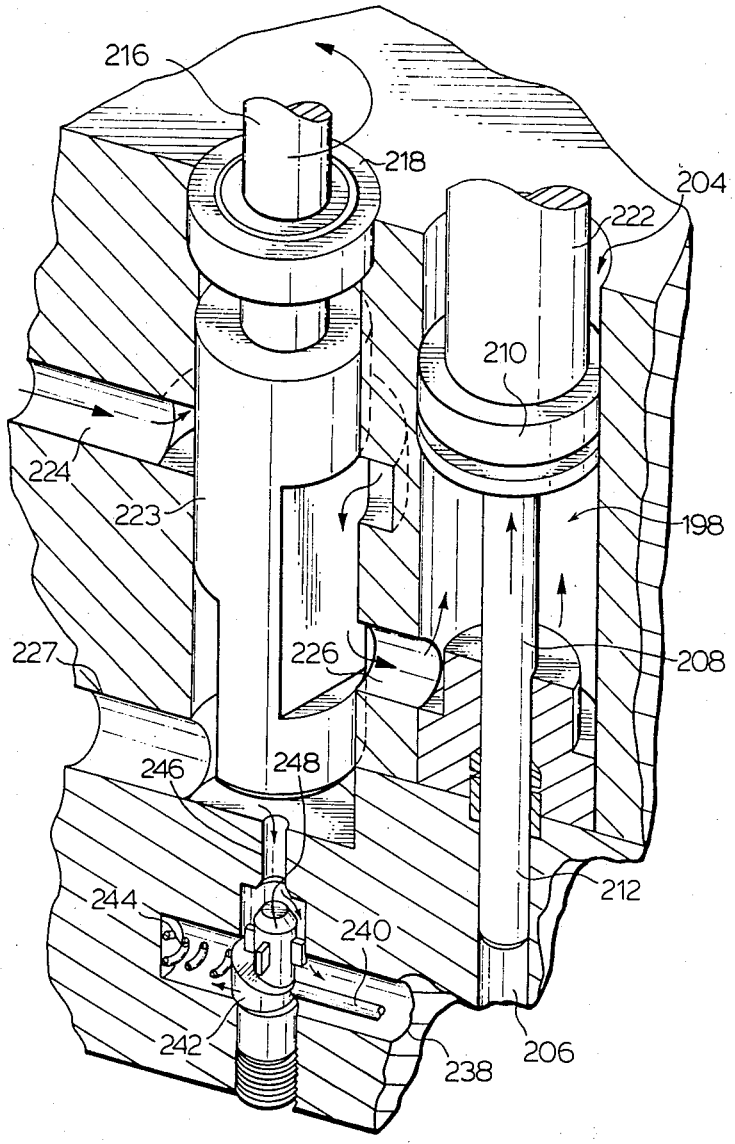
FIG. 7 is a cut-away perspective of a portion of FIG. 6.

This may be achieved by the embodiment of FIGS. 6 and 7. In addition, this further embodiment has certain other advantages in that it provides for essentially a double-acting pumping function, which may be arranged to provide a greater compactness and a greater high pressure flow or a larger number of pulses per unit of time than the embodiment of FIGS. 1 to 5.

The principle of operation of this alternative embodiment is essentially the same as that already described. Thus it will be seen to comprise upper and lower pumping units 200 and 202 respectively and which are essentially mirror images of one another. Each of the units 200 and 202 is provided with three low pressure cylinders 204 and high pressure cylinders 206, which are provided with respective piston sets 208. Each of these piston sets 208 comprises a low pressure piston 210 and a high pressure piston 212. The two piston sets 208 which are axially aligned with each other will be referred to as a piston assembly 198.

A central rotary valve shaft 216 is mounted in bearings 218 and is rotated by means of swash plate 220. Swash plate 220 interengages with notches 221 formed in intermediate connecting rods 222. Each intermediate rod 222 interconnects the two low pressure pistons 210, so that the two piston sets 208 which are in alignment with one another also move in unison as a piston assembly 198.

Connecting rods 222 are separate from low pressure pistons 210, and are movable relative thereto to accommodate movement of the peripheral edge of swash plate 220 in the radial direction.

In order to supply low pressure fluid to the low pressure cylinders 204, a pair of upper and lower valve assemblies 223 are mounted on the shaft 216, and both are rotated in unison by swash plate 220. The valve assemblies 223 are of somewhat similar design to the valve assembly shown in FIG. 1 and have inlet and outlet faces on opposite sides. Low pressure fluid will be supplied to the valve assemblies 223 by annular supply channels 224, which are both supplied by a single supply conduit 225, shown schematically. The annular channels 224 correspond to the annular neck 41 of FIG. 1, and supply fluid to the valve assemblies 223 around the full 360 degrees of rotation.

Transfer ports 226 connect with the low pressure cylinders 204, and outlet conduits 227 provide for the discharge of low pressure fluid.

The lower of the two valve assemblies 223 in FIG. 6 is shown in the supply mode, that is to say, with low pressure fluid flowing through the supply conduit 225, around the annular channel 224 and into the cylinder 204. The upper valve in FIG. 6 is shown in the return or outlet mode. In this mode, fluid is ejected through the end of the valve upwardly into the outlet conduit 227.

The upper and lower outlet conduits 227 are connected by conduit 228.

It will be noted that, in this embodiment, the two piston sets 208 are arranged in what may be called an axially opposed fashion, with the two low pressure pistons 210 facing toward one another and the two high pressure pistons 212 extending away from the assembly at opposite ends thereof.

The high pressure pistons 212 operate in cylinders 206 which are connected via passageways 230 to respective sealed bellows chambers 232 defined by bellows 234. The bellows 234 have piston heads 236 which may move to and fro in chambers 235 in response to pulses of high pressure from cylinders 206. The piston heads 236 are connected through passageways 238 by connecting rods 240 to cam members 242. Cam members 242 are slidable against springs 244.

Low pressure transfer passageways 246 connect outlet conduits 227 to passageways 238. Check valves 248 are located in passageways 246, and valves 248 seat cam members 242.

Valves 248 are operable to permit flow of low pressure fluid into passageways 238, to replenish any losses, when plunger rods 240 retract due to fluid leakage.

Screws 250 support cam members 242 in the desired positions in the passageways 238.

It will thus be observed that the high pressure fluid sides of the system are essentially closed sealed systems, so that high pressure pulses caused by high pressure pistons 212 will cause the piston heads 236 to extend and retract, within chambers 235.

Some other fluid such as, for example, oil or the like may fill the chambers 235 around the outside of the bellows 234. Such fluid may enter the chambers 235 via supply conduit 252, transfer conduits 254 and check valves 256.

Such fluid may exit from chambers 232 via one-way outflow valves 258, which are connected by an outflow conduit shown schematically at 260.

It will thus be seen that the high pressure pulses created by the six high pressure pistons 212, are transferred via the bellows 234 and pistons 236 to another fluid. In this way it is possible to use two different fluids in the system without them contacting each other.

Figure 8:
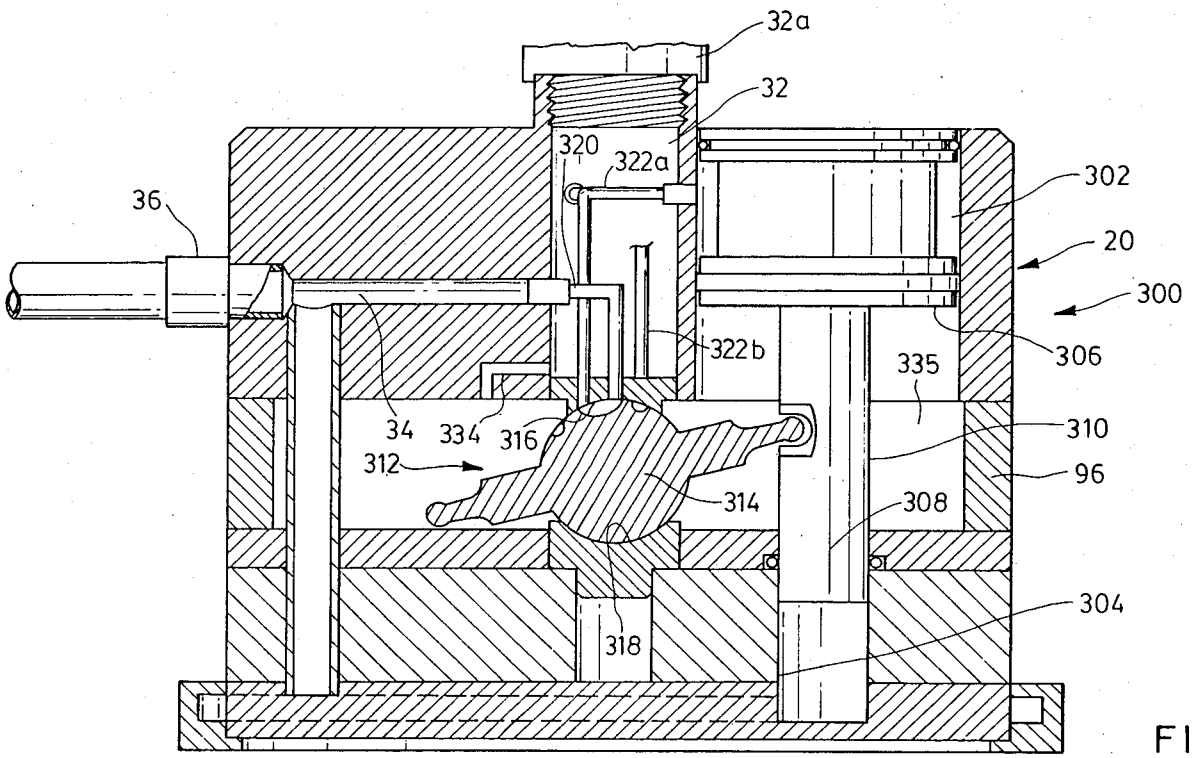
FIG. 8 is an illustration showing an alternative embodiment of an intensifier in accordance with this invention and which comprises a combined swash plate and valve assembly.

Referring now to FIGS. 8 to 11 of the accompanying drawings, it will be noted that there is shown therein a pressure intensifier indicated generally and schematically at 300 and including, as did the intensifier shown in the FIGS. 1 to 5, a plurality of pairs of opposed and co-axial low pressure and high pressure cylinders 302 and 304 respectively, only one such pir being shown in FIG. 8 for the sake of simplicity. As will become apparent as the description herein proceeds, the intensifier 300 will be considered as having three such pairs of cylinders.

The low pressure cylinders 302 house pistons 306 while the high pressure cylindes 304 house pistons 308 of smaller radial dimensions. Other component parts of the intensifier 300 which are identical with those of the intensifier shown in FIGS. 1 to 5 will be identified by the same legends.

The pistons 306 and 308 of each pair are interconnected by a rod 310 which engages a swash plate generally indicated at 312. The swash plate 312 comprises a ball 314 which is movably seated in opposed cups 316 and 318 formed as fixed parts of the body of the intensifier 300. The ball 314 and the cup 316 cooperate so as to provide a low pressure fluid control valve in a manner yet to be described.

Figure 9:
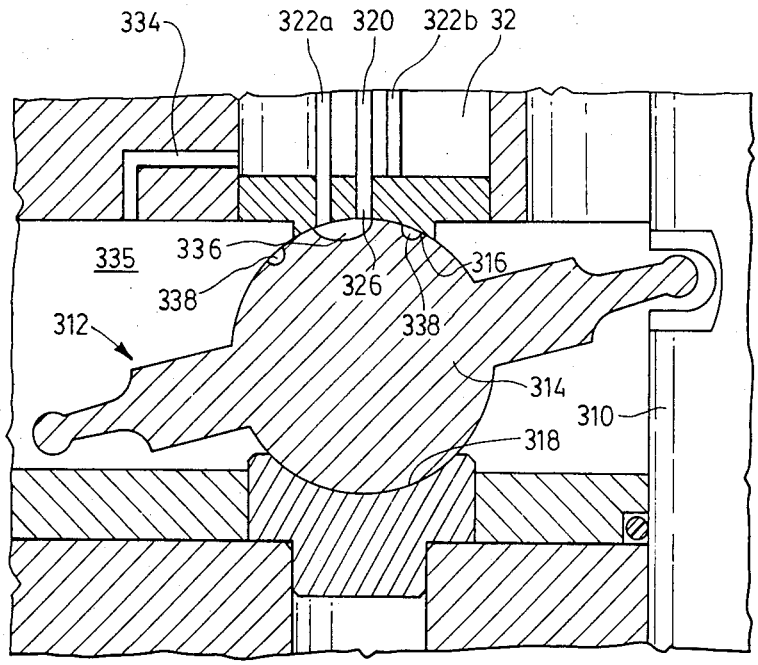
FIG. 9 is a fragmentary enlarged view of a ball and cup valve arrangement provided in the intensifier shown in FIG. 8.

From FIGS. 8 and 9, it will be noted that the intensifier 300 is provided with fluid conduits 320 and 322 which are open at ports 326 and 328 respectively in the cup 316. The conduit 320 is a low pressure fluid inlet passage through which low pressure fluid is supplied from supply fitting 36 and supply conduit 34. The conduits 322 provide low pressure fluid transfer passages through which fluid is transferred to the pressure ends of the low pressure cylinders 302. It will be understood that a separate low pressure fluid transfer conduit 322 will be provided for each one of the low pressure cylinders 302. For example, in the particular embodiment illustrated, three such transfer conduits 322 are provided, conduits 322*a* and 322*b* being shown in FIGS. 8 and 9.

Figure 11:
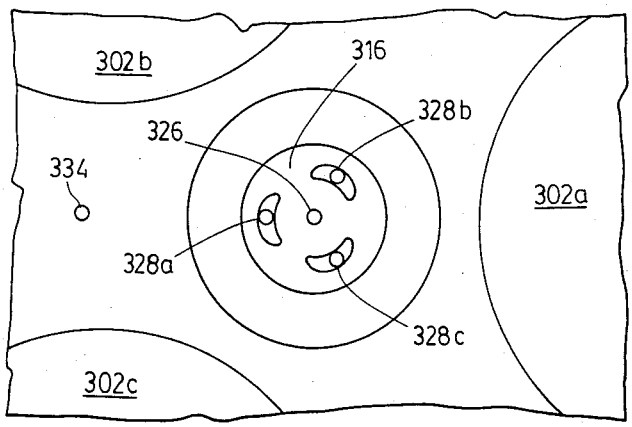
FIG. 11 is an underview of the cup forming part of the ball and cup arrangement of FIG. 9.

The positions and shapes of the supply port 326 and of the three transfer ports 328*a*, 328*b* and 328*c* are shown in FIG. 11.

For a reason which will become apparent as the description herein proceeds, a low pressure discharge transfer passage 334 is provided for the discharge of the fluid from the space 335 within the spacer ring 96 to the axial bore 32.

Figure 10:
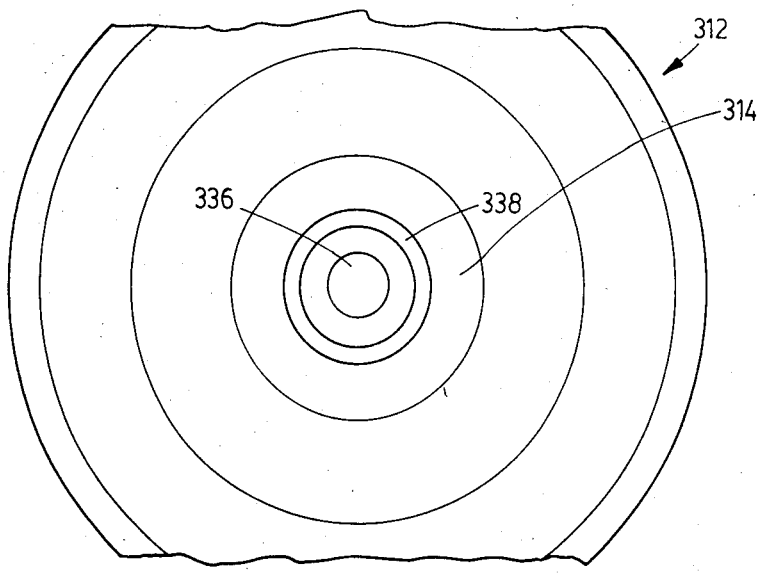
FIG. 10 is an illustration of the ball forming part of the ball and cup arrangement of FIG. 9.

Reference will now be made to FIGS. 9, 10 and 11 from which it will be seen that the ball 314 is formed in its surface with two recesses 336 and 338. On tilting of the swash plate 312, the recess 336 is selectively and sequentially operable to interconnect the fluid inlet passage 320 with the fluid transfer passages 322 so as sequentially to supply low pressure fluid to the pressure ends of the low pressure cylinders 302. The annular recess 338 is operable sequentially to be aligned with the transfer passages 322 so as to permit discharge of low pressure fluid from the low pressure cylinders 302 during the discharge strokes of the low pressure pistons. Such discharged fluid flows through the recess 338 and into the space 335 containing the swash plate 312, so displacing fluid from that space through the discharge transfer passage 334 and into the axial bore 32.

It will be understood that such flow of the low pressure fluid through the space within the spacer ring 96 is possible and advantageous when the low pressure fluid is a liquid, such as oil, which will then be effective to lubricate the moving parts of the intensifier contained within that space 335. Obviously, where the low pressure fluid is not a lubricant, the annular recess 338 would be positioned so as sequentially to permit the flow of fluid from the low pressure cylinders 302 to a separate fluid discharge passage opening into the cup 316.

The foregoing is a description of preferred embodiments of the invention which is given here by way of example only. The invention is not to be taken as limited to any of the specific features as described, but comprehends all such variations thereof as come within the scope of the appended claims.

What is claimed is:

1. A pressure intensifier for a fluid medium and comprising:

a stationary low pressure cylinder block portion defining two ends;

stationary high pressure cylinder block portions located at respective ends of said low pressure cylinder block;

at least three piston assemblies, said piston assemblies being disposed along mutually parallel axes equiangularly disposed with respect to a central axis of said intensifier and radially equidistant therefrom, each said piston assembly comprising:

low pressure cylinder means in said low pressure cylinder block portion;

a pair of axially aligned and opposed high pressure cylinders coaxially disposed with said low pressure cylinder means in said high pressure cylinder block portions;

low pressure piston means disposed within said low pressure cylinder means for axial movement therein; and, a pair of high pressure pistons disposed within respective ones of said high pressure cylinders for axial movement therein, each said pair of high pressure pistons being linked to said low pressure piston means for conjoint axial movement therewith;

low pressure fluid supply means for the supply of low pressure fluid to said low pressure cylinder means of each said piston assembly;

low pressure fluid discharge means for the discharge of low pressure fluid from said low pressure cylinder means of each said piston assembly;

movable low pressure valve means in said low pressure cylinder block portion and disposed along a central axis thereof within said mutually parallel axes of said piston assemblies, and being movable within said low pressure block portion, said valve means being coupled to said low pressure cylinder means of each said piston assembly and adapted to control the supply of low pressure fluid to said low pressure cylinder means of each said piston assembly from said low pressure fluid supply means and to control the discharge of low pressure fluid from said low pressure cylinder means of each said piston assembly to said low pressure fluid discharge means;

valve drive transmission means operatively coupled to each of said piston assemblies between said two high pressure pistons of each said piston assembly, and disposed within said mutually parallel axes of said piston assemblies whereby movement of said piston assemblies in response to supply of low pressure fluid will cause movement of said low pressure valve means, and simultaneously synchronize movement of said piston assemblies;

high pressure fluid supply means for supplying fluid to said high pressure cylinders; and, high pressure fluid collector means for receiving high pressure fluid from said high pressure cylinders.

2. A pressure intensifier as claimed in claim 1 and in which said low pressure valve means comprises a central rotary valve shaft, a rotary valve on said shaft and operable to distribute fluid to respective low pressure cylinder means as it rotates, and a rotary drive device on said valve shaft, in driving engagement with said low and high pressure piston assemblies.

3. A pressure intensifier as claimed in claim 1 and which includes a fluid transfer passageway communicating between said low pressure fluid supply means and said high pressure fluid supply means, a plurality of high pressure fluid distribution passageways communicating from said high pressure fluid supply means to a respective ones of said high pressure cylinders for supplying fluid thereto, and one-way flow valve means in said high pressure fluid distribution passageways.

4. A pressure intensifier as claimed in claim 1 in which each said piston assembly comprises a said low pressure piston means and cylinder having a predetermined first diameter, and said high pressure pistons and cylinders each having a predetermined diameter less than the diameter of said low pressure piston and cylinder means.

5. A pressure intensifier as claimed in claim 4 and in which said valve drive transmission means comprises a swash plate mechanism.

6. A pressure intensifier as claimed in claim 5, in which said swash plate mechanism comprises a swash plate mounted on an axial shaft of said intensifier and in which said low pressure valve means is mounted on said axial shaft and adapted to interconnect for fluid flow therebetween a fluid supply port and a fluid discharge port sequentially and alternately with a fluid transfer port for each of said low pressure cylinder means.

7. A pressure intensifier as claimed in claim 1 and in which said high pressure fluid collector means and said high pressure cylinders comprise a closed circuit for each said piston assembly including pressure reaction means for reaction to high pressure therein.

8. A pressure intensifier as claimed in claim 7 and in which said pressure reaction means comprises a bellows means forming a fluid tight barrier and disposed in a pump chamber for pumping a second fluid through said pump chamber.

9. A pressure intensifier as claimed in claim 8 and which comprises a passage interconnecting said low pressure fluid discharge means and said closed circuit and including a replenishment flow control valve for replenishing fluid in said closed circuit for fluid losses due to leakage.

10. A pressure intensifier as claimed in claim 9 and in which said bellows means is secured to a movable piston head carrying an actuating piston rod connected to said replenishment flow control valve for actuating that valve.

11. A pressure intensifier for a fluid medium and comprising:

at least three piston assemblies, said piston assemblies being disposed along mutually parallel axes equiangularly disposed with respect to a central axis of said intensifier and radially equidistant therefrom, each said piston assembly comprising:

a pair of low pressure cylinders;

a pair of axially aligned and opposed high pressure cylinders coaxially disposed with said low pressure cylinders;

a pair of low pressure pistons disposed within said low pressure cylinders for axial movement therein; and, a pair of high pressure pistons disposed within respective ones of said high ressure cylinders for axial movement therein, each said pair of high pressure pistons being connected to said low pressure pistons for conjoint axial movement therewith by linkage means for transmitting axial movement therebetween;

low pressure fluid supply means for the supply of low pressure fluid to said low pressure cylinders of each said piston assembly;

low pressure fluid discharge means for the discharge of low pressure fluid from said low pressure cylinders of each said piston assembly;

low pressure valve means coupled to said low pressure cylinders of each said piston assembly and adapted to control the supply of low pressure fluid to said low pressure cylinders of each said piston assembly from said low pressure fluid supply means and to control the discharge of low pressure fluid from said low pressure cylinders of each said piston assembly to said low pressure fluid discharge means;

valve drive transmission means operatively coupled to each of said piston assemblies whereby movement of said piston assemblies in response to supply of low pressure fluid will cause movement of said low pressure valve means, and simultaneously synchronize movement of said piston assemblies;

high pressure fluid supply means for supplying fluid to said high pressure cylinders; and, high pressure fluid collector means for receiving high pressure fluid from said high pressure cylinders.

12. A pressure intensifier as claimed in claim 11, in which, in each said piston assembly, said high pressure cylinders and said low pressure cylinders are interconnected and in which said low pressure pistons are connected to said low pressure valve means by said valve drive transmission means so that, in each said piston assembly, axial movement of said low pressure piston of one of said first and second pairs of cylinders and pistons is effective through a respective one of said linkage means to cause axial movement of said high pressure piston of the other of said first and second pair of cylinders and pistons, and vice-versa.

13. A pressure intensifier for a fluid medium and comprising:

at least three piston assemblies, said piston assemblies being disposed along mutually parallel axes equiangularly disposed with respect to a central axis of said intensifier and radially equidistant therefrom, each said piston assembly comprising:

at least one low pressure cylinder;

at least one axially aligned and opposed high pressure cylinder coaxially disposed with said low pressure cylinder;

a low pressure piston disposed within said low pressure cylinder for axial movement therein; and a high pressure piston disposed within said high pressure cylinder for axial movement therein, said high pressure piston being connected to said low pressure piston for conjoint axial movement therewith;

low pressure fluid supply means for the supply of low pressure fluid to said low pressure cylinder of each said piston assembly;

low pressure fluid discharge means for the discharge of low pressure fluid from said low pressure cylinder of each said piston assembly;

a swash plate operatively interconnecting said pistons of said piston assemblies and comprising a ball connected to said swash plate and movably supported in a fixed cup formed in said intensifier;

low pressure valve means comprising a low pressure fluid supply passage, and a plurality of low pressure transfer passages, said passages opening as ports in said fixed cup and said transfer passages communicating with respective ones of said low pressure cylinders, and recesses in the surface of said ball for permitting fluid transfer between respective pairs of said ports in said cup for controlling the supply of low pressure fluid to said low pressure cylinder of each said piston assembly from said low pressure fluid supply means and the discharge of low pressure fluid from said low pressure cylinder of each said piston assembly to said low pressure fluid discharge means;

high pressure fluid supply means for supplying fluid to said high pressure cylinders; and high pressure fluid collector means for receiving high pressure fluid from said high pressure cylinders.

* * * * *